US005611383A

United States Patent [19]

Hoffman

[11] Patent Number: 5,611,383

[45] Date of Patent: Mar. 18, 1997

[54] REINFORCED ROLL-UP SHUTTER

[76] Inventor: Robert E. Hoffman, 5618 Riviera Dr., Coral Gables, Fla. 33146

[21] Appl. No.: 630,938

[22] Filed: Apr. 5, 1996

Related U.S. Application Data

[63] Continuation of Ser. No. 283,353, Aug. 1, 1994, abandoned.

[51] Int. Cl.[6] ..... E06B 9/08

[52] U.S. Cl. ..... 160/133; 160/235

[58] Field of Search ..... 160/133, 235, 160/236, 233, 232

[56] References Cited

U.S. PATENT DOCUMENTS

| | | | |
|---|---|---|---|
| 2,804,641 | 9/1957 | Zavada | 160/235 X |
| 3,485,287 | 12/1969 | Milbourne, Jr. | 160/235 |

FOREIGN PATENT DOCUMENTS

| | | | |
|---|---|---|---|
| 759779 | 5/1965 | Canada | 160/236 |
| 698252 | 11/1965 | Italy | 160/236 |

*Primary Examiner*—Blair Johnson
*Attorney, Agent, or Firm*—Harness, Dickey & Pierce, P.L.C.

[57] ABSTRACT

A roll-up shutter is formed of numerous, identical, horizontally elongated slats each having a pair of oppositely and downwardly extended hooks formed on its upper edge and a downwardly opening groove on its lower edge for receiving the hooks of the next adjacent slat. The lower edges of the walls forming the groove in each slat are bent inwardly and upwardly to provide inner channels. The pair of hooks of one slat are normally engaged within the corresponding pair of channels of the next adjacent slat. The hook and channel on one side of each slat are arranged at a higher level than the corresponding hook and channel on the other side of each slat. When the shutter is opened, to cover a window or doorway opening, the engaged hooks and slats, which extend substantially along the full width of the shutter, form horizontally arranged, bar-like reinforcements for the shutter. When the shutter is rolled-up, the slats pivot about the hook and channel engagements located at the inner curvature of the rolled shutter while the hooks and channels located on the outer curvature of the rolled shutters move apart to permit pivoting.

4 Claims, 1 Drawing Sheet

10
11
12
13
14
15
16
17
18
19
24
25
26
30
31
32

REINFORCED ROLL-UP SHUTTER

This is a continuation of U.S. patent application Ser. No. 08/283,353 filed Aug. 1, 1994, abandoned.

BACKGROUND OF INVENTION

This invention relates to an improved roll-up shutter formed of horizontally elongated slats which are pivotally connected together along their upper and lower edges. The improvement relates to shutter edge connections which provide reinforcing, bar-like strips extending along the width of the shutter to resist penetration by forcefully hurled objects.

Roll-up shutters are conventionally made of relatively thin, narrow, horizontally elongated slats which are connected together along their adjacent edges. Typically, these slats are formed of aluminum or plastic extrusions. In such extrusions, the body of each slat is formed in a roughly rectangular cross-sectional shape to provide a hollow interior. The upper edge of each slat is provided with a hook-like bend which fits into a channel formed in the lower edge of the next adjacent slat for pivotally connecting the two slats together.

When the shutter is opened, so that the slats are in a generally vertical plane for providing a closure, each slat is suspended from the slat next above it by the connection of their respective hook bends and channels. The shutter is rolled-up, around an axis, which may be in the form of an interior axle or shaft, so that the adjacent slats pivot relative to each other during the rolling procedure.

Roll-up shutter slats as described above are common and generally operate on the same principle. The cross-sectional shapes of the slats may vary from one shutter to another. Also, conventional slats, which are usually formed in a hollow box-like cross-section, may contain interior reinforcing ribs or other interior structures for rigidifying each slat to some extent.

Although these conventional roll-up type shutters are relatively strong, they are susceptible to penetration or breakage if a sufficiently forceful impact is applied against them. That is, a rapidly moving object, such as wind-hurled debris thrown by a high-velocity, hurricane force winds, might penetrate or break apart the shutter, particularly at the connections between its slats. Thus, it is desirable, especially in areas which are subject to hurricane strength winds where wind-hurled objects are a danger, to provide a means for reinforcing each shutter to resist penetration by such flying objects.

The invention herein relates to an improved slat connecting pivot configuration which functions to provide reinforcing strips along the width of the shutter.

SUMMARY OF INVENTION

This invention contemplates connecting adjacent slats, of a roll-up shutter, by forming a downwardly curved hook on each face of, and along the upper edge of each slat. Each slat lower edge has a downwardly opening channel, which receives the pair of hooks of the next lower slat. The opposite walls forming each channel are curved upwardly to provide a pair of grooves within which the pair of hooks are engaged. The hooks and channels on one face of each slat are at a higher level than the hooks and grooves on the opposite face of the slat. Thus, the engaged hooks and channels provide a pair of closely spaced, horizontally extending reinforcing bar-like or bead-like strips at the upper and the lower edges of each slat.

When the shutter is open, that is, when it is unrolled so that it extends in a generally planar sheet to cover a window opening or door opening of a building, the adjacent pairs of reinforcing strips, at the upper and lower edges of each slat, rigidity the shutter and resist separation of adjacent slats. But, when the shutter is to be rolled-up, the arrangement of the hooks and the grooves within which they fit permit the adjacent slats to pivot around the engaged hook and groove at one face of the shutter while the hook and the groove connections at the opposite face of each shutter separate sufficiently to permit the pivoting action.

One object of this invention is to provide a shutter formed of conventional appearing slats which give the general appearance of being the same as those in presently used roll-up shutters. However, the hook and groove engagements, which are concealed within the edges of the slats, provide substantial reinforcement against penetration.

Another object of this invention is to provide an improved slat connection which provides, without any substantial increase in cost and without any need for additional labor, substantial reinforcement of what otherwise appears to be a conventional roll-up shutter.

Still another object of this invention is to provide a conventional appearing shutter made of what appears to be conventional extruded metal or plastic slats that have inexpensive easy to assemble connections that provide impact resistance reinforcements for the shutter.

These and other objects and advantages of this invention will become apparent upon reading the following description, of which the attached drawings form a part.

DETAILED DESCRIPTION

Figures 1, 2, 3, 4, 5:
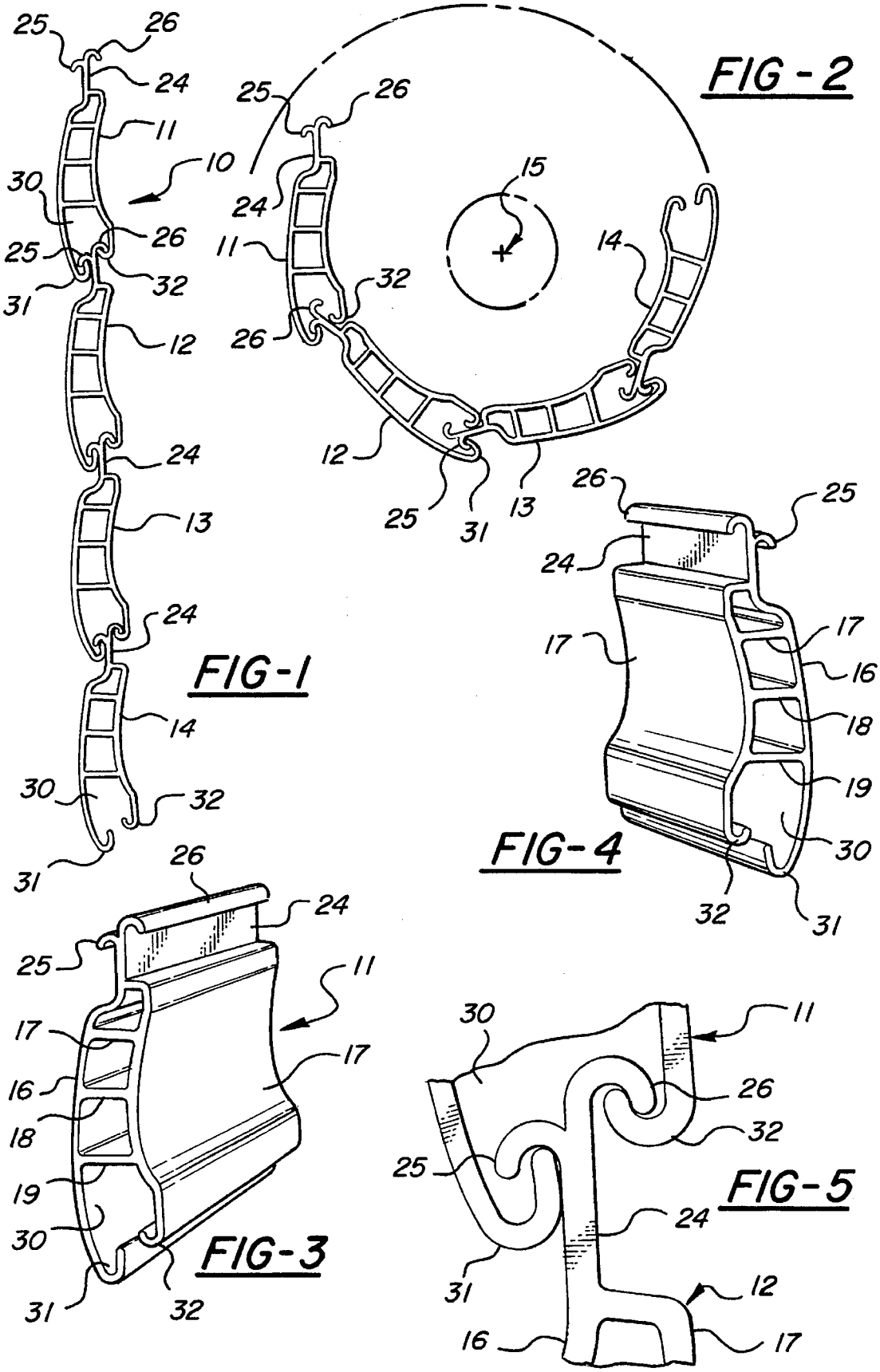
FIG. 1 is a side edge, elevational view of a portion of a roll-up shutter showing its slats arranged in a roughly vertical plane for covering a window opening in a building.
FIG. 2 is a edge, elevational view, showing the portion of the shutter rolled-up for uncovering the window opening.
FIG. 3 is a perspective view of a slat.
FIG. 4 is a perspective of the opposite face of the slat.
FIG. 5 is an enlarged, fragmentary view, of the connection between two adjacent slats.

FIG. 1 illustrates a portion of a roll-up shutter 10. An actual shutter would comprise a large number of slats which are of identical construction and which are connected together in edge-to-edge relationship. Such slats are typically formed of extruded aluminum or of extruded plastic.

For illustrative purposes, four slats 11, 12, 13 and 14 are illustrated in FIG. 1, with the slats suspended, one from each other, to provide the shutter. Each slat is connected to the slat next above it.

FIG. 2 illustrates the same four slats, 11, 12, 13, and 14, in a rolled-up configuration. For purposes of illustration only four slats are shown. However, in actual practice, the numerous slats which make up a single shutter, would be wound around a central axis 15. The central axis, shown schematically, would generally be formed of an axle or a shaft or a roller which connects to, and extends along, the upper end of the shutter and about which the shutter is wound. Since such a roller or shaft arrangement is conventional, and forms no part of this invention, it is not further illustrated or described here.

Turning now to the slats, each slat is provided with a front face 16 and a rear face 17 to provide a hollow, roughly rectangular in cross-section, elongated structure. Each slat may have a series of integral webs, 18, 19, 20 and 21, extending between and integrally connecting the front and the rear faces of each slat. This is a conventional construction. The number and the location of such webs may vary.

Each slat is provided with an integral, upper edge flange 24. The free upper edge of the upper edge flange 24 is bifurcated. Each of the bifurcated legs is bent oppositely and downwardly. These bent legs form a forward curve or bent hook 25, which is generally in the plane of the front face 16 of the slat, and a rear curve or bent hook 26 which is generally in the plane of the rear face of the slat.

The lower edge of each slat is left open to form a downwardly open edge groove 30. This edge groove is defined by the lower portions of the front and the rear face wall portions of the slat. Each of these lower face portions are bent inwardly and upwardly to form a forward channel 31 and a rear channel 32. The two channels are spaced apart a short distance, as indicated in FIG. 5.

Preferably, the forward channel is deeper than the rear channel. As can be seen in FIGS. 3, 4, and 5, the rear hook 26 is arranged above, that is, at a higher elevation than, the forward hook 25. Similarly, the rear channel 32 is at a higher elevation than the forward channel 31.

When the pair of hooks are engaged in the corresponding pair of channels of the next adjacent slat, as illustrated in FIG. 5, each engaged pair of hook-channel portions form a horizontal strip extending along the length of the adjacent slats. That is, each pair of engaged hook-and-groove formations provides a horizontal bar-like or bead-like configuration which extends for the full width of the shutter. Because of the different elevations or heights of the engaged pairs of hook-channel formations, a closely spaced pair of such strips are located at the upper and, also, at the lower edge of each slat.

When the shutter is rolled-up, as can be seen in FIG. 2, the hook-and-channel arrangement at the forward faces of the slats provide hinge-like pivots. However, the hook-and-channel formations on the inner faces of the slats tend to move apart to permit the slats to pivot, relative to each other.

The slats are preferably extruded of aluminum or of plastics, as is conventional, so that the hooks, grooves, upper flange, webs and faces of each slat are formed as one integral member. Thus, the extruded slat strips may be cut the lengths desired for a particular size shutter. After the slats are cut from the extruded strips, the slats are inter-engaged by sliding the upper hooked ends of each slat into the channel of the next adjacent slat. The assembled shutter may then be secured to an appropriate roller or shaft in the conventional manner, using a conventionally constructed roller or shaft or axle.

Having fully described an operative embodiment of this invention, it is desired that the foregoing description be read as merely illustrative and not in a strictly limiting sense. Thus, this invention may be further developed within the scope of the following claims.

I now claim:

1. In a roll-up type shutter comprising numerous horizontally elongated substantially identical slats which are normally arranged in edge-to-edge relationship and are pivotally connected together along their adjacent edges for arranging the shutter either in an open condition, in which the slats are arranged generally co-planar for covering a building opening, or for rolling the shutter slats around a common axis for uncovering said opening, the improvement comprising:

each slat having an elongated, generally flattened body portion having a forward face and a rear face and an upper and a lower elongated edge portion;

the upper edge portion being formed with a flange, said flange being bifurcated to form a pair of oppositely extending, downwardly and outwardly bent hooks, each hook having a curve portion and an end portion extending from said curve portion providing an overall inverted U-shape so that the U of opposite hooks is substantially the same size, so that one hook is generally arranged at the forward face and the other hook is generally arranged at the rear face of the slat and the hook which engages the rear face positioned above the hook which engages the forward face;

the lower edge portion having a downwardly opening groove whose side walls terminate in inwardly and upwardly curved edge parts which form a pair of upwardly bent, spaced apart, interior channels, each curved edge part having a curve portion and an end portion extending from said curve portion wherein said channel adjacent said forward face being deeper than the other channel;

and with the pair of hooks on the upper edge of each slat normally engaging the edge parts of the corresponding pair of channels in the lower edge of the next adjacent slat such that said curve portion of each hook engaging its respective end portion of said curved part and said hook end portion extending into said curve portion of said curved edge part for suspending one slat beneath another and for providing a pivotal connection between the adjacent slats;

and with the adjacent slats arranged to pivot around the engaged hook and channel located at the forward face while the hook, which is engaged normally in the channel located at the rear face, may move generally outwardly of its respective channel when the adjacent slats pivot;

and the engaged hooks and channels of the slats forming the shutter, providing reinforcing strips along the width of the open shutter to resist penetration of the shutter by a forcefully applied article impacted against the shutter.

2. In a shutter as defined in claim 1 and wherein the channel at the forward face of the slat being correspondingly located above the channel located at the rear face of the slat.

3. In a shutter as defined in claim 2, and with said hooks and channels each extending substantially continuously along substantially the full lengths of their respective slats.

4. In a shutter as defined in claim 1 and wherein each of said slats is formed of a thin wall metal extrusion with the body portion of each slat being hollow.

* * * * *